US006896390B2

(12) United States Patent
Yu et al.

(10) Patent No.: US 6,896,390 B2
(45) Date of Patent: May 24, 2005

(54) ANIMATE FORM HEADLAMP

(75) Inventors: Sun Yu, Berkley, MI (US); David A. Perrin, Troy, MI (US); Anmena Yau, Hong Kong (CN)

(73) Assignee: Zen Design Group, Inc., Berkley, MI (US)

( * ) Notice: Subject to any disclaimer, the term of this patent is extended or adjusted under 35 U.S.C. 154(b) by 66 days.

(21) Appl. No.: 10/639,932

(22) Filed: Aug. 13, 2003

(65) Prior Publication Data

US 2005/0036304 A1 Feb. 17, 2005

(51) Int. Cl.[7] ..... F21S 6/00; A63H 33/26

(52) U.S. Cl. ..... 362/124; 362/103; 362/191; 362/155; 446/485

(58) Field of Search ..... 362/124, 103, 362/191, 155, 253; 40/411, 540; 446/392, 446/540

(56) References Cited

U.S. PATENT DOCUMENTS

| | | | | |
|---|---|---|---|---|
| 491,713 | A | 2/1893 | Main | |
| 928,744 | A * | 7/1909 | Fisher | 446/337 |
| 1,521,161 | A * | 12/1924 | Marshall | 362/124 |
| 1,744,777 | A | 1/1930 | Lundgren | |
| 2,234,995 | A | 3/1941 | Waechter | |
| 2,421,958 | A * | 6/1947 | Moretti | 362/124 |
| 2,483,107 | A * | 9/1949 | Sharp | 362/134 |
| 2,604,728 | A * | 7/1952 | Nudelman | 446/392 |
| 2,638,530 | A * | 5/1953 | Duda | 362/124 |
| 3,008,040 | A | 11/1961 | Moore | |
| 3,032,647 | A | 5/1962 | Wansky et al. | |
| 3,254,444 | A | 6/1966 | Paterson | 46/228 |
| 3,665,451 | A | 5/1972 | Keith | 340/321 |
| D238,958 | S | 2/1976 | Feinbloom | D48/20 H |
| D274,758 | S | 7/1984 | Shing | D26/39 |
| 4,631,645 | A | 12/1986 | Lenart | 362/105 |
| D300,868 | S | 4/1989 | Conforti | D26/39 |
| 4,945,458 | A | 7/1990 | Batts et al. | 361/106 |
| 5,006,971 | A | 4/1991 | Jenkins | 362/252 |
| 5,033,212 | A | 7/1991 | Evanyk | 36/137 |
| 5,327,588 | A | 7/1994 | Garneau | 2/422 |
| 5,329,637 | A | 7/1994 | Walker | 2/5 |
| 5,384,693 | A | 1/1995 | Schwaller et al. | 362/72 |
| D362,080 | S | 9/1995 | Lehrer et al. | D26/39 |
| D362,736 | S | 9/1995 | Leather | D26/39 |
| 5,485,358 | A | 1/1996 | Chien | 362/106 |
| 5,544,027 | A | 8/1996 | Orsano | 362/105 |
| 5,590,416 | A | 12/1996 | Rydbeck | 455/90 |
| D383,229 | S | 9/1997 | Kiichiro | D26/39 |
| 5,688,039 | A | 11/1997 | Johnson | 361/106 |

(Continued)

*Primary Examiner*—Sandra O'Shea
*Assistant Examiner*—Ali Alavi
(74) *Attorney, Agent, or Firm*—Gifford, Krass, Groh, Sprinkle, Anderson & Citkowski, P.C.

(57) ABSTRACT

A headlamp includes a housing securable to a human appendage. Within the housing a battery is located. Upon activation of a switch, the battery forms an electrical circuit with a light source located within the housing and directed to project a light beam therefrom. The housing is formed as an animate head having a mouth portion aperture defined by a hingeably secured jaw portion such that a light beam emanating from the light source projects through the aperture. The housing modifies the shape of the light beam and creates an inducement for a child-pedestrian to use the headlamp.

13 Claims, 3 Drawing Sheets

U.S. PATENT DOCUMENTS

| | | | | |
|---|---|---|---|---|
| D394,720 | S | 5/1998 | Yuen | D26/39 |
| D405,202 | S | 2/1999 | Fattori et al. | D26/39 |
| 5,931,559 | A | 8/1999 | Pfaeffle | 362/106 |
| 6,097,287 | A | 8/2000 | Lu | 340/479 |
| 6,113,244 | A | 9/2000 | Baumgartner | 362/106 |
| 6,244,721 | B1 | 6/2001 | Rodriguez et al. | 362/106 |
| D445,931 | S | 7/2001 | Shiu | D26/39 |
| D447,586 | S | 9/2001 | Shing | D26/39 |
| D447,587 | S | 9/2001 | Poon | D26/39 |
| 6,290,370 | B1 | 9/2001 | Bouffay et al. | 362/203 |

* cited by examiner

ANIMATE FORM HEADLAMP

FIELD OF THE INVENTION

The present invention generally relates to a headlamp having a selectively removable light beam shaping aperture.

BACKGROUND OF THE INVENTION

In spite of the admonitions of adults, children outdoors rely on the attentiveness of motorists for their safety. A leading cause of accidents involving vehicles is the inability of a motorist to detect the presence of a child-pedestrian. The inability of a motorist to observe a child-pedestrian is further compounded during darkness and the early twilight seen in northern climates during the winter months. Additionally, holiday associated events such as trick or treating and caroling place child-pedestrians in an environment with vehicles under low ambient light conditions.

Prior art attempts to make child-pedestrians more visible have routinely focused on incorporating reflective elements into outerwear articles. These efforts have met with limited success owing to the child-pedestrian forgetting to wear the reflective article or quickly outgrowing the same. Alternatively, conventional bicycle indicator lights and headlamps have been advocated as child-pedestrian night safety devices. These, however, have met with limited success owing to the unwillingness of a child-pedestrian to wear such a light. Still another problem with conventional lights and headlamps is the confusion as to the identity of the light wearer. The typical conical reflector and resulting light beam is associated with bicycles and walkway lights found in residential areas and not a child-pedestrian. Thus, there exists a need for a child-pedestrian safety light that a child is desirous of wearing and that clearly identifies to a passing motorist that the light source indicates the proximity of a child-pedestrian.

SUMMARY OF THE INVENTION

A headlamp includes a housing formed as an animate head. A jaw portion is pivotally secured to said housing by a hinge. The housing and jaw define a mouth-shaped aperture. A securement maintains said housing in contact with a human appendage. A battery is located within the housing. A switch integrated into the housing selectively forms an electrical circuit between the battery and the light source located at least in part within the housing. A light beam from the light source projects through the mouth portion aperture.

DETAILED DESCRIPTION OF THE INVENTION

Figure 2:
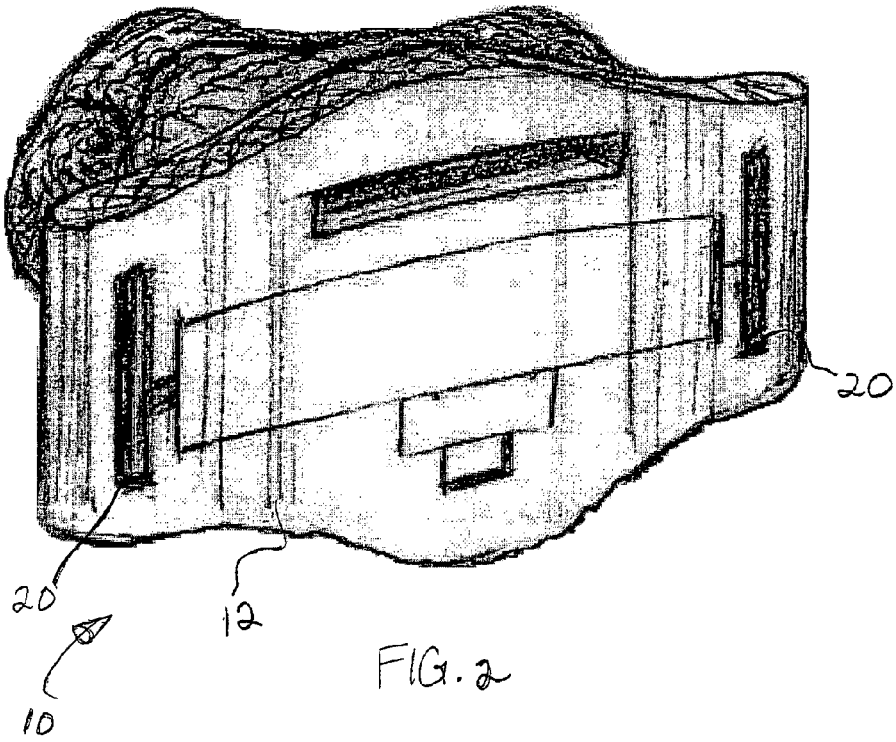
FIG. 2 is a perspective rearward view of an inventive embodiment of FIG. 1.
Figure 1:
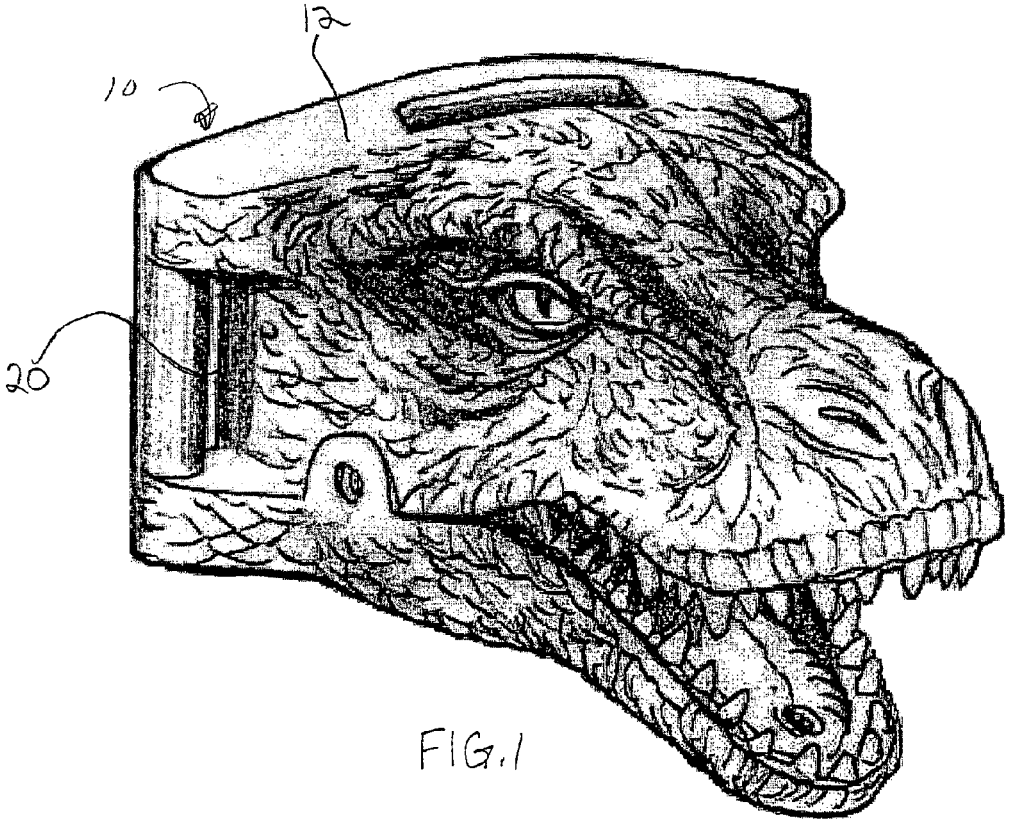
FIG. 1 is a perspective forward view of an inventive embodiment.
Figure 3:
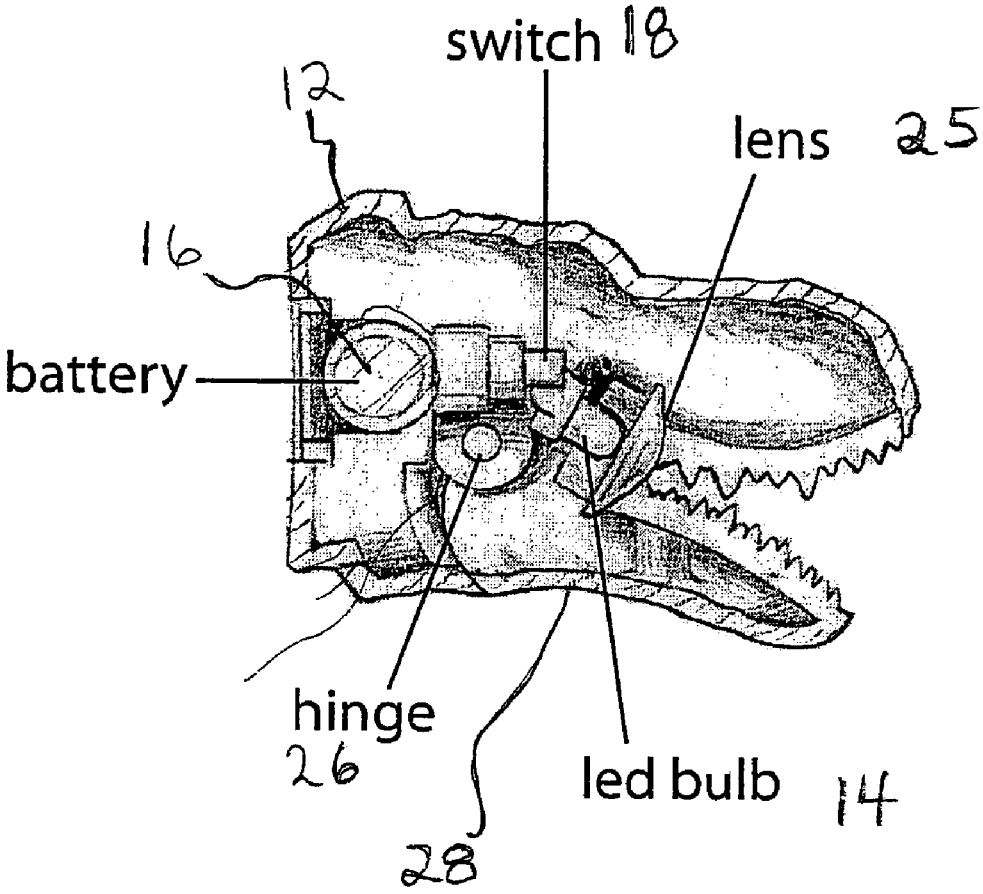
FIG. 3 is a longitudinal cross-sectional view of the embodiment depicted in FIG. 1.
Figure 4:
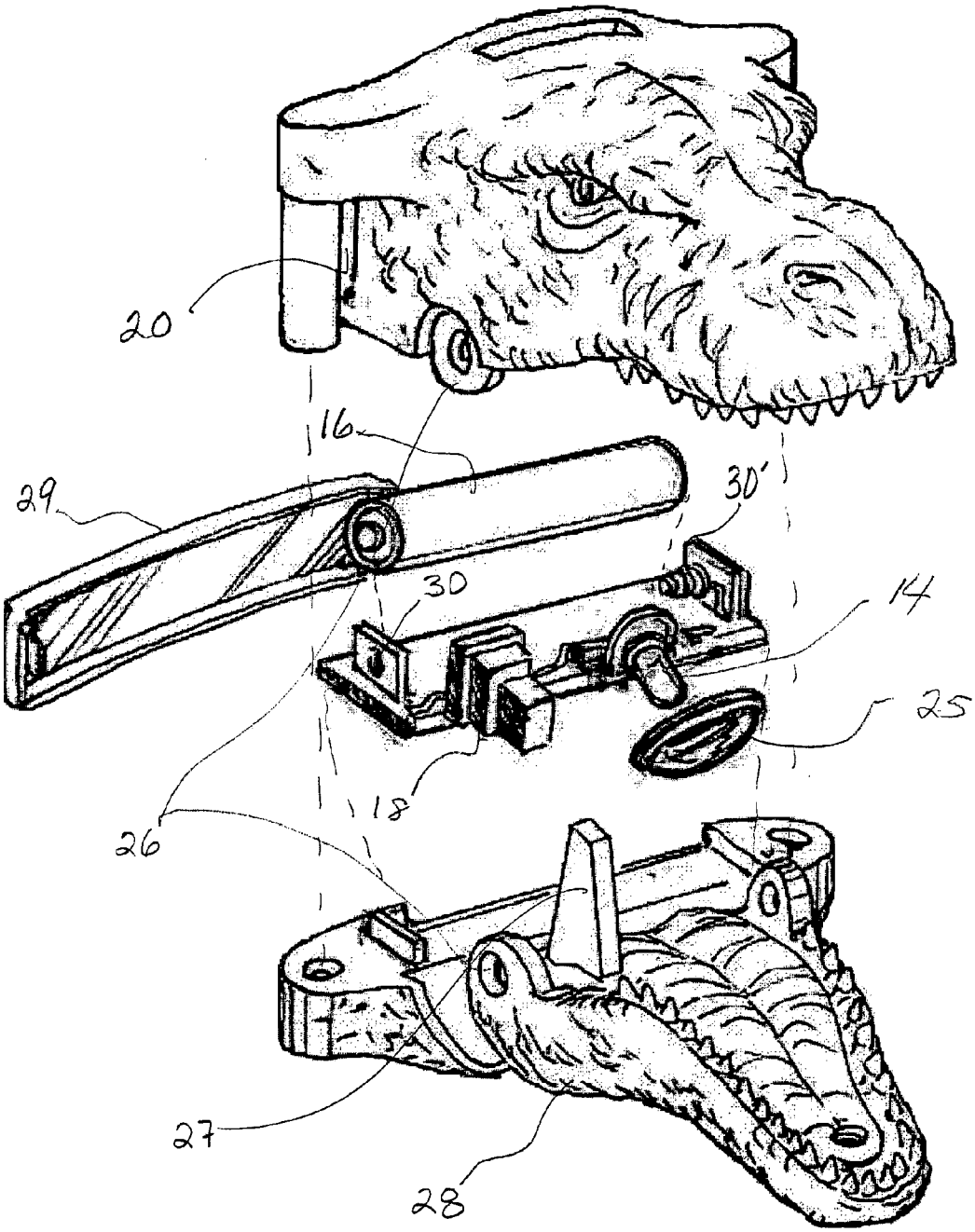
FIG. 4 is an exploded view of the embodiment depicted in FIG. 1.

The present invention has utility as an apertured headlamp that a child-pedestrian is inclined to wear. A headlamp in the form of an animate head has an illumination beam that is apertured to project through an opening corresponding to the mouth and optionally other openings corresponding to facial features such as nostrils, eyes, eyebrows or ears. While the invention is detailed herein in the context of a headlamp, it is appreciated that an inventive headlamp is readily secured to other human appendages, namely an arm or leg, chest or waist.

Referring now to the figures, an inventive headlamp is shown generally at 10. A light housing 12 encloses a light source 14 selectively in electrical contact with a battery 16 by way of a switch circuit 18. The light source 14 in the housing 12 also includes a securement aperture 20 to which a headband (not shown) is secured. The housing 12 is formed from any conventional flashlight housing materials, such as injection moldable thermoplastics. In a preferred embodiment, the battery 16 is enclosed within the housing 12. More preferably, an access panel 29 is provided in the housing 12 to afford replacement access to the battery 16. The battery 16 is retained between electrical contacts 30 and 30'. The housing 12 forms an animate mouth opening adapted to seat a focusing lens 25. The switch circuit 18 engages a lever portion 27 of the jaw 28 defining a portion of the mouth opening. Movement about the hinge 26 brings the lever portion 27 into contact with the switch 18 so as to activate or deactivate the light source 14. Therefore, closure of the spring-biased jaw 28 brings the light source 14 into a closed electrical circuit with the battery 16 through contacts 30 and 30'. The jaw 28 then returns to an open position with light projecting from the light source. Repeating the motion of the jaw 28 deactivates the light source 14.

In an alternate embodiment, the battery power source is separate from an otherwise similar inventive light source housing. Preferably, the battery power source is mounted to a securement headband and placed at the back of a user head so as to balance a securement headband mounted inventive headlamp residing over a user forehead. A conductive wire interconnects the battery power source with the headlamp.

A light source operative within the present invention includes an incandescent bulb or a solid state device such as a light emitting diode. The light source is appreciated to include a single element or multiple light emitting elements. Preferably, the light source is a light emitting diode (LED). The light source being conventional to the art. LEDs are operative herein in any number of light emission colors illustratively including red, orange, yellow, green, blue and white. It is appreciated that the battery voltage and power characteristics are largely dictated by the chosen light source.

A battery operative in the present invention is chosen such that alone or in a circuit with other batteries is sufficient to drive light emissions from the light source. Batteries operative herein include cylindrical batteries such as AAA, AA, A, metal hydride and lithium containing batteries; cuboidal batteries such as an alkaline 9-volt; and button-type batteries such as lithium containing batteries. Preferably, a button type battery is used. It is appreciated that to drive certain light sources a series circuit of batteries is utilized.

The animate appearance of the housing 12 is a critical factor in inducing a child-pedestrian to utilize the present invention and thereby remain visible to motorists under low ambient light conditions. The aperture animate head appearance illustratively takes the form of a cartoon character, a puppet, an animal, a caricature, an historical personage or a fictional literary character. The housing 12 is formed from any number of conventional plastics and optionally is formed of a material conventional to the art at a thickness that renders the animate head portion of the housing 12 translucent. Alternatively, a fluorescent or phosphorescent material is interspersed throughout the housing 12 thereby causing the housing 12 to glow under incident external light stimulation or through activation of the light source 14. Optionally, the housing 12 is painted or otherwise decorated. The housing 12 has an opening therein corresponding to the animate jaw 28 of the head. Typically, the jaw 28 is spaced from one centimeter to four centimeters from the complementary mouth portion of the housing 12. The spacing between the jaw 28 and housing 12 serves to shape the light projected from an inventive headlamp 10. Preferably, the mouth opening formed by the jaw 28 is shaped to afford a noncircular beam projection onto an orthogonal surface. A noncircular light projection beam emanating from the jaw 28 further serves to identify the light source as being non-typical of bicycles and other conventional sources and instead emanating from a child-pedestrian. Movement of the hinged jaw 28 relative to the fixed mouth portion of the housing 12 affords a means for adjusting the shape and intensity of light projecting from an inventive headlamp 10 and further adds to the desirability of a child-pedestrian to wear an inventive device 10. Optionally, openings are also formed in the aperture corresponding to other head orifices such as eyes, eyebrows, nostrils or ears. While it is appreciated that the amount of light projecting through the mouth 50 relative to other facial orifices is variable, the cumulative effect is intended to attract the attention of a passing motorist.

All patents cited herein are indicative of the level of skill in the art. These patents are hereby incorporated by reference to the same extent as if each individual patent was specifically and individually incorporated by reference.

In view of the teachings presented herein, other modifications and variations of the present invention will be readily apparent to those skilled in the art. The foregoing drawings and description are illustrative of preferred embodiments of the present invention, but are not to meant to be limitations on the practice thereof. It is the following claims, including all equivalents, which define the scope of the invention.

What is claimed is:

1. A headlamp comprising:

a housing formed as an animate head;

a jaw portion;

a hinge pivotally securing said jaw portion to said housing to define a mouth-shaped aperture;

a securement for securing said housing to a human appendage;

a battery;

a light source within said housing directed to project a light beam from the aperture; and a switch selectively forming an electrical circuit between said battery and said light source.

2. The headlamp of claim 1 wherein said hinge is spring biased.

3. The headlamp of claim 1 wherein the aperture further comprises a phosphor dispersed therethrough.

4. The headlamp of claim 1 wherein the aperture is spaced between one and four centimeters from said light source.

5. The headlamp of claim 1 wherein said battery is located within said housing.

6. The headlamp of claim 1 wherein said battery is remote from said housing.

7. The headlamp of claim 6 wherein said battery is coupled to said securement and further comprising an electrical conductor selectively in electrical communication between said battery and said light source.

8. The headlamp of claim 1 wherein said switch is activated by pivoting said jaw portion about said hinge.

9. The headlamp of claim 1 wherein said housing has an opening corresponding to a portion of the animate head selected from the group consisting of: an eye, an eyebrow, a nostril and an ear.

10. The headlamp of claim 1 wherein said housing is translucent.

11. The headlamp of claim 1 wherein said housing is painted.

12. A process for making a child-pedestrian visible under low ambient light conditions, said process comprising the steps of:

securing a lamp to a human appendage, said lamp comprising:

a housing formed as an animate head;

a jaw portion;

a hinge pivotally securing said jaw portion to said housing to define a mouth-shaped aperture;

a securement for securing said housing to a human appendage;

a battery;

a light source within said housing directed to project a light beam from the aperture; and a switch selectively forming an electrical circuit between said battery and said light source; and activating said lamp to project the light beam through the aperture.

13. The process of claim 9 wherein the aperture is noncircular.

* * * * *